US005952654A

United States Patent [19]

Giese

[11] Patent Number: 5,952,654

[45] Date of Patent: Sep. 14, 1999

[54] FIELD-RELEASE MASS SPECTROMETRY

[75] Inventor: Roger Giese, Quincy, Mass.

[73] Assignee: Northeastern University, Boston, Mass.

[21] Appl. No.: 08/960,305

[22] Filed: Oct. 29, 1997

[51] Int. Cl.[6] ..... H01J 49/04

[52] U.S. Cl. ..... 250/288; 436/155; 436/173

[58] Field of Search ..... 250/288; 436/155, 436/173; 435/6

[56] References Cited

U.S. PATENT DOCUMENTS

| | | | |
|---|---|---|---|
| 4,902,627 | 2/1990 | Kidwell | 436/112 |
| 5,210,412 | 5/1993 | Levis et al. | 250/288 |
| 5,376,788 | 12/1994 | Standing et al. | 250/288 |
| 5,622,824 | 4/1997 | Koster | 250/288 |

FOREIGN PATENT DOCUMENTS

| | | | |
|---|---|---|---|
| WO9428418 | 12/1994 | WIPO | G01N 33/543 |

OTHER PUBLICATIONS

Bruenner et al., "Quantitative Analysis of Oligonucleotides by Matrix–assisted Laser Desorption/Ionization Mass Spectrometry", *Rapid Communications in Mass Spectrometry*, 10:1797–1801, 1996.

Ching et al., "Polymers as Surface–Based Tethers with Photolytic Triggers Enabling Laser–Induced Release/Desorption of Covalently Bound Molecules", *Bioconjugate Chemistry*, 7:525–528, 1996.

Ching et al., "Surface Chemistries Enabling Photoinduced Uncoupling/Desorption of Covalently Tethered Biomolecules", *J. Org. Chem.*, 61:3582–3583, 1996.

Drouot et al., "Step–by–step Control by Time–of–flight Secondary Ion Mass Spectrometry of a Peptide Synthesis Carried Out on Polymer Beads", *Rapid Communications in Mass Spectrometry*, 10:1509–1511, 1996.

Egner et al., "Solid Phase Chemistry: Direct Monitoring by Matrix–Assisted Laser Desportion/Ionization Time of Flight Mass Spectrometry. A Tool for Combinatorial Chemistry", *J. Org. Chem.* 60:2652–2653, 1995.

Fitzgerald et al., "Direct Characterization of Solid Phase Resin–Bound Molecules by Mass Spectrometry", *Bioorganic & Medicinal Chemistry Letters*, 6:979–982, 1996.

Hutchens et al., "New Desorption Strategies for the Mass Spectrometric Analysis of Macromolecules", *Rapid Communications in Mass Spectrometry*, 7:576–580, 1993.

Nelson et al., "Quantitative Determination of Proteins by Matrix–Assisted Laser Desorption/Ionization Time–of–Flight Mass Spectrometry", *Anal. Chem.*, 66:1408–1415, 1994.

"Field Desorption Mass Spectrometry", Laszlo Prokai, Hungarian Oil and Gas Research Institute Veszprem, Hungary and College of Pharmacy, University of Florida, Gainesville, Florida, Marcel Dekker, Inc., p. 3, 1990.

Röllgen, "Field desorption mass spectrometry", *Trends in Analytical Chemistry*, 1:304–307, 1982.

van der Greef, "Field desorption mass spectrometry in bioanalysis", *Trends in Analytical Chemistry*, 5:241–242, 1986.

Voivodov et al., "Surface Arrays of Energy Absorbing Polymers Enabling Covalent Attachment of Biomolecules for Subsequent Laser–Induced Uncoupling/Desorption", *Tetrahedron Letters*, 37:5669–5672, 1996.

*Primary Examiner*—Jack I. Berman
*Attorney, Agent, or Firm*—Weingarten, Schurgin, Gagnebin & Hayes LLP

[57] ABSTRACT

Methods of releasing and analyzing substrates such as DNA, comprising: a) covalently or ligandly binding substrate to a first electrode via a release group, which release group is cleavable in response to applied energy; b) introducing an electrical field so as to establish a charge potential between the first electrode and a second electrode separated by a vacuum or gas phase from the first electrode, the strength of such field sufficient to bristle said covalently-bound or ligandly-bound substrate; and c) applying sufficient energy directly to the release group to cleave the release group and release the substrate into a vacuum or gas phased

41 Claims, 1 Drawing Sheet

FIELD-RELEASE MASS SPECTROMETRY

CROSS-REFERENCE TO RELATED APPLICATIONS n/a

STATEMENT REGARDING FEDERALLY SPONSORED RESEARCH OR DEVELOPMENT n/a

BACKGROUND OF THE INVENTION

This invention relates to analysis of chemical substances including particulates, especially the detection of biomaterials such as DNA by mass spectrometry (MS).

Release groups in chemistry are molecular groups which function by undergoing covalent or ligand bond cleavage under certain chemical or physical conditions. They are used to link one substance to another in cases where the linked substances later need to be released. For example, in solid phase organic synthesis, a release group may be employed to link the compounds being synthesized to a solid support. In chemical analysis, a signal group may be linked by a release group to an analyte, and then the resulting signal-release group-analyte conjugate can be measured by releasing and detecting the signal group. Release groups also are used sometimes in affinity chromatography to effect the temporary attachment of a ligand to a solid support.

Field desorption mass spectrometry (FD-MS) involves the desorption of an ion from a surface by an intense electrical field (e.g. $10^6$–$10^8$ V/cm). Such field intensity is achieved by desorbing the sample from a sharp tip or edge, as provided, for example, by microscopic needles deposited pyrolytically from a carbon source onto a wire. FD-MS is a very "soft" ionization technique, but when heat is used to enhance sample desorption, fragment ions are more likely to form.

Another known analytical method is laser desorption MS (LD-MS), e.g., direct and matrix-assisted laser desorption ionization (MALDI), where only the latter employs a matrix which absorbs the energy of the laser pulse. The resulting disturbance of the matrix in turn desorbs analyte which is present within or on the surface of the matrix. In direct LD, the analyte per se (and most likely also the solid support on which it is deposited) absorbs the laser energy, leading to desorption.

DNA sequencing by MS has been studied, including MALDI and electrospray techniques employing several strategies such as measurement of dideoxy sequencing ladders, enzymatic ladder sequencing, and sequencing by gas-phase fragmentation. Practical DNA sequencing by mass spectrometry, however, has not progressed much beyond the 120-mer level, largely due to problems with depurination, fragmentation and adduct ions. This includes loss of signal strength for longer DNA fragments.

Covalent MS has been used to demonstrate that samples covalently bound to a solid surface can be measured directly by desorption mass spectrometry. For example, a covalently bound peptide on a resin particle has been detected by MALDIMS. The peptide was linked to the particle by a photolabile α-methylphenacyl ester linker, and a pulse of photons from a nitrogen laser both cleaved this group and desorbed the peptide. Similar measurement of a covalently-bound peptide, involving a photolabile benzyloxy group, has been accomplished by TOF-SIMS, and peptides have been detected by laser desorption TOF-MS where a photolabile pyridinium group was employed to covalently link the peptide to the probe surface. However, these latter two studies were conducted without applying an electrical field.

While time-of-flight mass spectrometry (TOF-MS) potentially offers high sensitivity and throughput at low cost for detection of chemical substances including macromolecules and particulates, it has been limited especially by the performance of the ion source, where the analyte in the sample is transformed into gas phase ions. If these analyte ions initially are spread out in energy or space, traveling in different directions, contaminated with nonanalyte substances (including the formation of undesirable adducts or complexes), or have energies which make them less detectable or cause any undesired fragmentation, then the overall performance of the TOF-MS technique will be poorer. There is a great need to improve the ion source in TOF-MS (and in other MS techniques such as those using ion traps for detection) in a way that overcomes these problems. For example, DNA sequencing by TOF-MS of DNA dideoxy sequencing ladders could be improved greatly, potentially making this the best way to do DNA sequencing in terms of speed, cost, accuracy and sensitivity.

SUMMARY OF THE INVENTION

The invention relates in one aspect to methods of releasing a substrate into a vacuum or gas phase, comprising: a) covalently or ligandly binding the substrate to a first electrode via a release group which release group is cleavable in response to applied energy; b) introducing an electrical field so as to establish a charge potential between the first electrode and a second electrode separated from the first electrode by a vacuum or gas phase, the strength of the field sufficient to bristle the substrate; and c) applying sufficient energy to the release group to cleave the release group and release the substrate into said vacuum or gas phase. In at least some cases 10% or more of the total amount of the substrate that is released from the first electrode is nonobstructively exposed before release via the vacuum or gas phase to the second electrode.

An embodiment relates to methods of releasing into a vacuum or gas phase a substrate covalently or ligandly bound to a first electrode via a release group which release group is cleavable in response to applied energy, comprising a) introducing an electrical field so as to establish a charge potential between the first electrode and a second electrode separated from the first electrode by a vacuum or gas phase, the strength of the field sufficient to bristle the substrate; and b) applying sufficient energy to the release group to cleave the release group and release the substrate into the vacuum or gas phase. In some cases at least 10% of the total amount of the biomaterial that is released from the first electrode is nonobstructively exposed before release via the vacuum or gas phase to the second electrode.

Another embodiment relates to a method of analyzing a substrate comprising a) covalently or ligandly binding the substrate to a first electrode via a release group, which release group is cleavable in response to applied energy; b) introducing an electrical field so as to establish a charge potential between the first electrode and a second electrode separated from the first electrode by a vacuum or gas phase, the strength of such field sufficient to bristle said covalently-bound or ligandly-bound substrate; c) applying sufficient energy to the release group to cleave the release group and release the substrate into the vacuum or gas phase; and d) detecting the released substrate. In some cases at least 10% of the total amount of the substrate that is released from the first electrode is nonobstructively exposed before release via the vacuum or gas phase to the second electrode.

A method of bristling a substrate covalently or ligandly bound to the tip of a first electrode is also disclosed, comprising exposing the bound substrate to a vacuum or gas phase and introducing an electrical field so as to establish a bristling charge potential between said first electrode and a second electrode separated by a vacuum or gas phase from said first electrode.

In a preferred embodiment the substrate is a biomaterial such as DNA, the release group is a photolabile release group covalently or ligandly attached to the first electrode, and the surface of the first electrode is a sharp edge or tip where the analyte is attached.

BRIEF DESCRIPTION OF THE SEVERAL VIEWS OF THE DRAWING

The invention will be more fully understood by reference to the following Detailed Description Of The Invention in conjunction with the following Drawings, of which:

FIG. 3 is an electron micrograph of a molybdenum tip array (500–600 points/$mm^2$) created by vacuum deposition/etching techniques, which may be used as a suitable first electrode or multiple first electrode for attachment of one or more substrates.

DETAILED DESCRIPTION OF THE INVENTION

Figure 2:
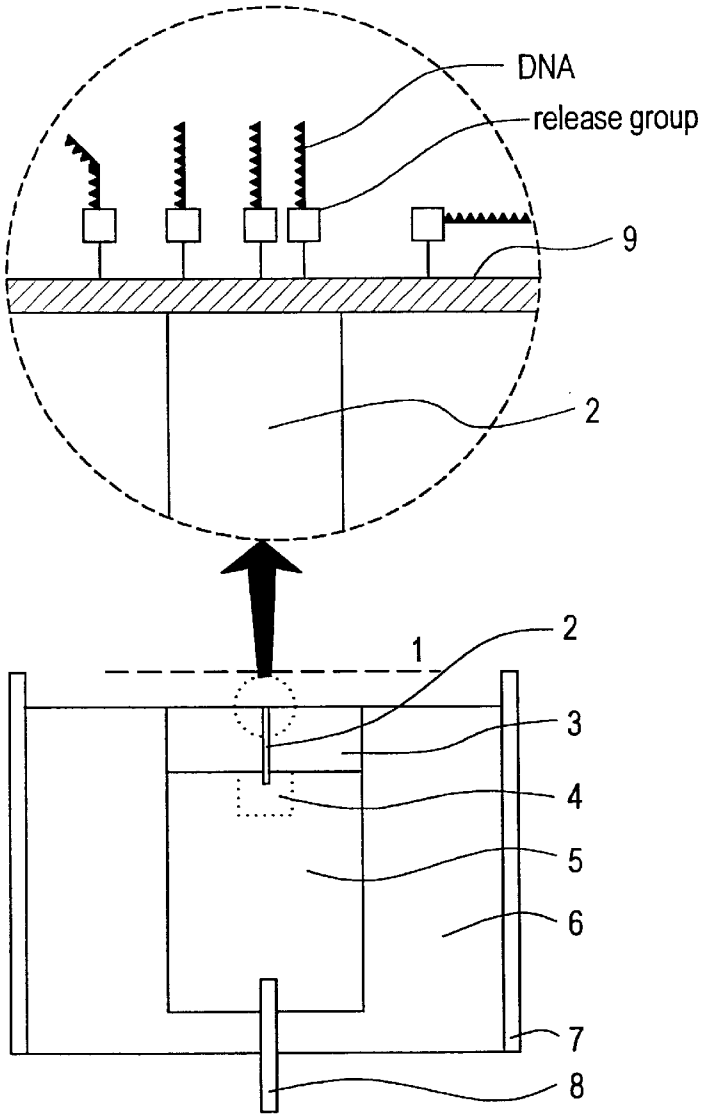
FIG. 2 depicts a first electrode in accordance with the invention illustrated in simplified form.

This invention is useful in several ways. In the area of mass spectrometry, the invention may be used for improving the analysis of substances by reducing their fragmentation, reducing their adductions, increasing their signal strength, and achieving higher resolution. This is especially important in the structural elucidation (including sequencing) of macrobiomolecules such as nucleic acids, proteins, polysaccharides, complex lipids, and combinations thereof, all of which are suitable substrates for use in the invention. Noncovalent complexes of these molecules with ligands or with each other sometimes can be studied more effectively. The analysis of combinatorial libraries can be improved. Industrial polymers can be characterized more easily or thoroughly. For all of these kinds of substances, and for related substances including particulates, higher masses and more delicate substances can be analyzed, both qualitatively and quantitatively, by means of the disclosed technique. The invention is particularly valuable for DNA sequencing, where existing mass spectrometry techniques have failed to be very useful since the problems of fragmentation, base loss, adductions, and loss of signal strength at high masses have prevented the sequencing of long DNA molecules.

The invention is also useful for the controlled release of molecular or particulate substances from one surface to another. For example, a landing surface, where the desorbed substrates deposit, can be placed between the first and second electrode. Alternatively, the desorbed substrate can land on the second electrode. This can be useful as a means to alter the surface of the first electrode, or of the landing surface, to change its electrical, reflective, adsorption, biocompatibility, biosensor, signaling, friction, adhesive, reactivity, charge, porosity, absorption, electrochemical, fluorescence, luminescence, nonspecific binding, affinity, thermal, fouling, leaching, chemical, optical, resistance, solubility, wetting, color, or hardness properties. The release, transport, or landing of the substrate can also be used for signaling purposes; as a way to detect energy such as photons, heat, or electricity; as a way to do microfabrication (e.g., to build up or change micro- or nanostructures); for information processing or storage; to detect molecular or mechanical movement; to characterize molecular or particulate substances, or control the orientation of the substrate on the first electrode or landing surface to modify the chemical or physical behavior of the substrate or of the adjacent surface. The bristling per se (bristling the substrate without releasing it) is also useful for some of these applications, especially the opportunity to change the properties of the surface or the substrate of the first electrode reversibly.

The analytical methods disclosed herein involve the use of molecular release groups to covalently or ligandly attach one or more parts such as an end of a substrate such as DNA to a first electrode; introduction of an intense electrical field to perturb or "bristle" the substrate attached to the first electrode; and subsequent cutting of the release group by a pulse of energy to release the substrate into the vacuum or gas phase for detection. Vacuum conditions are preferred. The vacuum or gas phase can include gases such as $O_2$, $SF_6$ and polyhalogenated hydrocarbons to suppress electrical discharges.

These analytical methods improve the detection of substrates (such as dideoxy DNA sequencing ladders by time-of-flight or ion trap MS) by minimizing the internal energy of the released substrate. Ordinarily the energy needed to desorb or release a substrate from a surface (release energy) is provided by an energy source other than the electrical field (such as a laser), and the electrical field then is used just to enhance the transmission of the released substrate towards the second electrode. Unfortunately, much of this release energy can deposit into the released substrate, raising its internal energy (which is different than its translational kinetic energy), so that it fragments prior to detection. This is undesirable in many cases including measurement of dideoxy DNA sequencing ladders. Indeed, ordinary desorption techniques may be self-defeating when it comes to minimizing the internal energy of the desorbed substrate, since the ordinary mechanism for substrate desorption may depend on the substrate undergoing an increase in its internal energy. This problem is overcome herein by creating a new mechanism for releasing the substrate from the surface that minimizes the internal energy of the released substrate. The new mechanism is the bristling of the substrate by the electrical field. By changing the way in which the substrate is oriented on the surface, bristling makes it possible to use a lower or different kind of release energy that deposits less energy into the released substrate. For example, in the case of release energy supplied by photons, a lower dose of photons, or photons whose energy is directed just towards the release group, can be applied. In the extreme bristling case, the entire release energy is provided by the electrical field, and the photons or other energy source merely cleave the release group without adding any internal energy at all to the released substrate.

"Substrate" is defined herein to mean biomaterials, molecules, particulate matter or organisms, whether organic or inorganic, which may be covalently or ligandly attached to a first electrode as described herein, e.g., without limitation, nucleic acids; proteins; lipids; polysaccharides; microorganisms; and microscopic organic or inorganic particles.

"Bristling" is defined herein as a condition of sufficiently heightened potential energy, or change in energy distribution, of the bound substrate caused by application of the electrical field between the first electrode and the second electrode to measurably enhance the release and propagation of intact substrate from the first electrode in the general direction of the second electrode, once the release group has been cleaved. The bristling arises from a change in the net charge, or a change in distribution of the overall charge, on the substrate because of the electrical charge between the first and second electrode (although this theory is not meant to be limiting on the invention.) "Released" means that the substrate is no longer attached covalently or ligandly to the first electrode. The "first electrode" is what the release group is attached to at one part or end, while being attached to the substrate at another part or other end. There may be more than one covalent or ligand attachment between the first electrode and the substrate.

The field strength is increased to the point where the covalently-bound or ligandly-bound substrate is bristled. This means that the charge distribution of the substrate is changed significantly, including the possibility (which is preferred) that the substrate acquires a net charge due to a transfer of charge between the substrate and the surface to which it is attached (first electrode). This change in charge distribution includes not only any shift in the distribution of the electrons of the substrate, but also any change in the distribution of the counterions associated with a charged substrate.

Bristling can be revealed by comparing the laser desorption mass spectrum of a covalently-bound or ligandly-bound substrate obtained under field conditions high enough to cause bristling with that obtained under ordinary field conditions. The mass spectrum for the substrate changes in one or more of the following, favorable ways in going to bristling field conditions, including the use of different laser conditions that are ineffective without the bristling: first appearance or increased intensity of the peak for the intact substrate; sharpening of this peak due to a narrower energy distribution of its ions, and disappearance or less intensity of one or more peaks for substrate fragment ions. Bristling can also be revealed by observing a change in the reflective, electrical, absorptive, fluorescence, luminescence, color, or other optical properties of the surface in going to bristling conditions.

As noted above, the substrate is covalently or ligandly bound to the first electrode, as opposed to adsorption on the surface, or adsorption or covalent or ligand attachment within a matrix. As such the covalently or ligandly bound substrate has some freedom of movement to enable bristling by the electrical field and cleavage of the release group by the applied energy as disclosed herein. In some cases at least 10% or more of the total amount of substrate on the first electrode is nonobstructively exposed before release to the vacuum or gas phase space between the electrodes, preferably $\geqq$50%, more preferably $\geqq$90%.

The necessary field strength generally ranges from at least $\geqq 10^5$ V/cm to $10^8$ V/cm, advantageously from $10^6$ V/cm to $10^8$ V/cm. The field strength for a particular bound substrate will depend on the specifics of the bound substrate, nature of covalent or ligand attachment, etc., but is not difficult to determine, as shown in the specific example of DNA disclosed hereinbelow.

There are two aspects to bristling, for example, DNA: changing its orientation on the surface (such as lifting some of it off the surface) in the first place, and then sustaining the bristle. The latter event should require a lower field strength than the former, since the bristled DNA should be more isolated from the surface. A very high field may be necessary to bristle the DNA initially, as discussed below. A force of about $\leqq$0.1 nanoNewton (nN) is believed to be sufficient to bristle DNA. A force of 0.1 nN corresponds to 0.62 V/Å or $6\times10^7$ V/cm. Periodically, random motion of electron(s) or counterion(s) will place one or more negative charges on the DNA, and the sustained field thereby will tend to progressively bristle the DNA on the surface until the DNA is fully bristled, assuming that the bristled state for the DNA is favored under the influence of the external field. Many DNA samples may be incubated on a multi-probe chip to bristle in parallel for an extended period of time (e.g. minutes) before the samples are released rapidly, one at a time, by a laser for detection by MS.

The tip or edge of the first electrode may be flat or rounded, and may be sharp like a needle or like a razor blade. When the tip or edge is flat, the width is typically less than 100 $\mu$m, and preferably less than 10 $\mu$m, where the substrate is covalently or ligandly bound. When the tip is rounded, the radius is typically less than 100 $\mu$m, and preferably less than 10 $\mu$m.

DNA may bristle most easily on a neutral surface. While it may be helpful to employ a first electrode surface bearing a negative charge to inherently repel the DNA, it must be kept in mind that counterions tend to be present, and that DNA is routinely precipitated from water by ethanol, in spite of the negative charge on the DNA molecules, since an ionic lattice develops.

Bristling of DNA may also be promoted by exposing the DNA-loaded first electrode to moderate or high humidity before inserting it into the instrument (e.g., mass spectrometer). The ensuing evaporation of the molecular film of water (or ice) under high vacuum and field is believed to facilitate bristling. Similarly, semivolatile additives such as ethylene glycol, propylene glycol, naphthalene, phenol, ammonium acetate, and triethylammonium acetate may be applied to the immobilized DNA sample on the first electrode surface as an aqueous or organic solution. Evaporation would lead to a thin molecular film of the additive. After the first electrode was inserted into the instrument and subjected to a vacuum with the field turned on, continued evaporation of the additive (including residual water) could assist in bristling. With too much additive, however, electrical discharge may be a problem. Nonvolatile additives may also be helpful, e.g., SDS, EDTA, dextran sulphate, polyethylene glycol, sucrose, urea, crown ether, glycine, cholesterol and sodium cholate.

The first electrode may comprise a metal selected from the group consisting of gold; silver; cobalt; tin; copper; gallium; arsenic, and mixtures thereof. Gold, notably, is suitable as a field release wire or film in the invention. The high melting point makes it resistant to heating processes that may be employed in fabricating the first electrode. It is dissolved by aqua regia, enabling sharpening or etching a tip. Gold reacts spontaneously (i.e., chemisorption) with thiols, making it convenient to immobilize a variety of organic molecules on its surface, including functionalization of a gold surface with aminoethyl or N-hydroxysuccinimide ester functional groups.

The first electrode may further comprise a surface coating to provide an advantageous means of attachment for the substrate(s). Such coatings, e.g., polyimide, may be further functionalized, e.g., with primary amino groups for this purpose. For example, polyimide membranes may be exposed to a 50% solution of ethylenediamine in methanol at room temperature for 15 minutes, followed by thorough methanol washing. The ethylenediamine transaminates the amide bonds in the polyimide coating.

Three factors which limit the resolution for detecting dideoxy DNA sequencing ladders by mass spectrometry are adduct ions, fragmentation and depurination. This invention minimizes each of these problems. Since the biomaterial, e.g., DNA, will be immobilized on a solid surface in the absence of a matrix, it may be washed prior to release to optimize counterions.

The first electrode is desirably a tip, wire, or razor edge, so as to obtain the highest field strength conditions. A first electrode in accordance with the invention is illustrated in simplified form in FIGS. 2*a* and 2*b*. Anode screen (second electrode), 1, which has transmission of, e.g., 90 percent, is located close to the sample (1–10 mm is typical.) The sample is located on the flat or rounded tip of first electrode wire, 2. First electrode 2, in turn, is embedded in insulating resin 3, and also anchored in a plug of solder in anchor hole 4. Metal plug 5 is a cylindrical, short segment of, e.g., copper, rod which sits in an insulative, e.g., PTFE, receptacle 6 and is electrically connected to a power supply via contact 8. Ion guide 7 may be provided if necessary to ensure that the ions are drawn out linearly. The release group-substrate molecules may be attached either directly to the first electrode wire or to thin film, 9, on this wire. As a matter of convenience, sample can be applied outside of the first electrode wire zone, if desired. The insulating resin 3 can be omitted.

A first electrode may be prepared as follows. A wire (diameter typically from about 1 $\mu$m to 25 $\mu$m) is soldered in place and then a liquid insulating resin is poured around it and allowed to solidify. The tip of the wire may be made flat and flush with the resin surface by cutting with a razor blade and/or polishing. Alternatively, to achieve a higher field strength, the first electrode tip may be sharpened and/or etched. Rather than filling a cavity with the resin as indicated in FIG. 2*a*, the resin may be applied as a drop at the base of the wire. Also, the wire may extend above the resin surface. This may be important in case the resin acts to dampen the field intensity at the tip, and a higher field strength is necessary. Examples of resins that may be used are silicones, urethanes, acrylics (e.g., available as KONFORM products from Chemtronics), epoxies (e.g., high temperature epoxy from Epo-Tek), styrenes and polyimides. A glass "resin" can be prepared either using a flame or glass powder, or "Accu-glass" precursors (Allied Signal). Some resins will be susceptible to pyrolysis, but pyrolysis products with low m/z would not interfere. Multi-tip first electrode arrays may be used in the invention as well, such as shown in FIG. 3 (from Spindt, C. A. (1968), *A Thin-Film Field-Emission Cathode*, J. Appl. Physics 39, 3504–3505), which is an electron micrograph of a molybdenum tip array (500–600 points/$mm^2$) created by vacuum deposition/etching techniques, which may be used for attachment of sample.

A thin layer may be provided on the first electrode surface to provide functional groups for the covalent or ligand attachment of the release group-DNA primers. If a conducting film like gold paint is employed and the wire tip is flush with the resin surface, then the paint should not extend much beyond the tip in order to maintain a high field. This is not an issue if the film is nonconducting, however. A film will not be necessary in cases where DNA molecules may be attached directly onto a gold surface via, e.g., thiol chemisorption. However, in case a high field is necessary, there may be a risk of field emission of electrons. If a film is needed, it is desirably thin to enhance the field strength. In such cases the film may be single-use, so it matters little whether it survives the laser shot or not as long as the film products do not interfere with (TOF-MS) detection of the DNA fragments.

There are two general approaches that may be used to prepare a film on the first electrode. One is to covalently bond functional groups onto the wire, and then systematically add additional covalent molecular layers to increase film thickness. For example, cobalt may be reacted with 3-(2-aminoethylamino) propyltrimethoxysilane (functionalizing the surface with primary and secondary amines), and then succinic anhydride (leading to carboxyl functional groups). Also, tin oxide-functionalized electrodes with 3-aminopropyltrimethoxysilane and related reagents may be used, or gold derivatized with 11-mercaptoundecanoic acid, with the resulting carboxylic acids converted to N-hydroxysuccinimide esters followed by reaction with polylysine.

Another approach is to paint or spray a monomer or polymer on the surface, followed by polymerization and/or evaporation. For example, a metal tip can be coated with polyimide in this way. Examples of reagents which can be used to create such films are the same as those cited above to make the insulating resin. Also other polymers like nylon, polyacrylamide, agarose, and proteins may be used. When the wire tip is flush with the surrounding insulating resin, and the liquid film wets the resin, then it should coat the small wire tip whether the film wets the tip or not.

Figure 1:
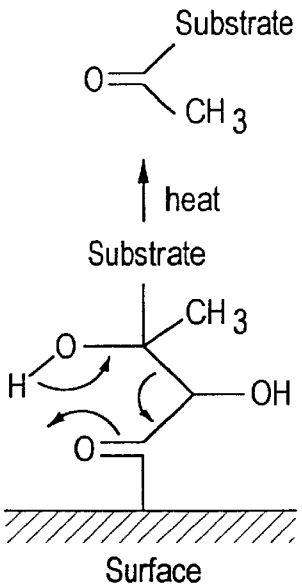
FIG. 1 is an example of an exemplary release structure and release mechanism.

One of the types of release groups which may be used is a thermal release group. Such a release group undergoes cleavage when heated. An example of an exemplary thermal release group and release mechanism is shown in FIG. 1. As seen, a β-hydroxyketo release group is observed to undergo a thermal retro-aldol reaction, releasing the substrate from a surface. This can take place, for example, when heat is provided by photons from a laser such as photons from a $CO_2$ laser. Other examples of thermal release groups are β-carboxylate esters, β-ketocarboxylates, phenolate esters and polycarbonates.

Thermal release group DNA molecules may be placed on the first electrode in two general ways: a) solid phase sequencing reactions conducted on the surface; or b) independent solution phase sequencing reactions followed by attachment of the product ladders to the surface. In either case, the release group either can be put on the surface first, followed by the DNA, or the release group can be incorporated first into the DNA followed by the attachment of the resulting conjugate to the surface. Solution phase sequencing products may be difficult to attach successfully to the surface because of steric effects and other factors causing a bias in which products immobilize. Nevertheless, the use of denaturing conditions and appropriate coupling chemistry such as gold-thiol or streptavidin-biotin reactions may be used to enable this approach to work.

An exemplary immobilization strategy is described herein in terms of a DNA primer immobilized at its 5'-end with a glycolketo thermal release group (photolabile release groups will be discussed below) to the tip. Aside from the preferred use of gold, the surface may contain primary amino groups. For example, reaction of a primary amino group with succinic anhydride yields a carboxylic acid, which can be converted to an active ester for coupling, in turn, to an amine. Reagents such as N-succinimidyl-3-[2-pyridyldithio] propionate and N-succinimidyl-S-acetylthioacetate may be used to label a primary amine, leading to a thiol. For example, one may start with an acetylphenone moiety to generate a glycolketo release group compound functionalized as an NHS ester. More specifically, the ketone is reacted sequentially with ethyl N-(diethylphosphonoacetyl)-isonipecotate (Wittig reaction), aqueous potassium hydroxide (ester hydrolysis) osmium tetroxide/pyridine (olefin→glycol), and N-hydroxysuccinimide/1-ethyl-3-(3-dimethylaminopropyl)-carbodiimide (acid→ester). Much of this same chemistry may be used to convert an amino-functionalized solid surface to a glycol/keto release group-NHS ester surface, ready for reaction with a 5'-aminoalkyl DNA primer. For this 4-acetylbenzoic acid is first converted to its corresponding NHS ester. Reaction of this NHS ester with the amino surface would yield an acetophenone-functionalized surface that would then be subjected to the above reaction sequence.

Another option for immobilizing DNA primers, in this case putting the release group on the DNA first, is to start with 4'-aminoacetophenone. After the amino group is protected with a carbobenzyloxy (Cbz) protecting group, the compound is converted to a glycolketo release group compound similarly as above, except the alkaline hydrolysis step is omitted so that the final product is an ethyl rather than NHS ester. This is reduced by catalytic hydrogenation to the corresponding amine which is coupled onto an NHS-functionalized solid surface. The immobilized ester is then hydrolyzed, converted to an NHS ester, and reacted with a 5'-aminoalkyl DNA primer. Yet another option is to react an amino-functionalized surface with disuccinimidyl tartrate, a bifunctional cross-linking agent that contains a built-in glycolketo linkage. The surface would then be reacted immediately with a 5'-aminoalkyl DNA primer.

A spacer may be introduced between the substrate and the release group to better insulate the substrate from the physical and chemical events at the electrode surface. For example, several polyethylene glycol derivatives such as bis [acetic acid], bis [amine]; bis [imidazocarbonyl]; and bis [biotin] derivatives may be used. As necessary, the substrate on the surface may be diluted with spacer molecules to minimize intermolecular interactions among these molecules. For example, 1-thio-undecyl-11-yltri(ethylene glycol) may be used for this purpose.

The same chemical strategies already described for preparing thermal release group immobilized substrate can similarly be used to prepare photolytic release group samples. Further, as already described earlier, substrates such as DNA with a photolytic release group such as onitrobenzyl may be affixed to a solid surface and released effectively with UV radiation. The 355 nm photons will be absorbed only by this group, and not by either the DNA or an appropriate probe surface. This may further help to minimize the internal energy of the released DNA. A polyethylene glycol spacer can be employed as done above with the glycolketo release group.

Other examples of photolytic release groups that may be used are β-methylphenacyl ester, benzyloxy and pyridinium. A ligand interaction also may be used as a release group, for example, a complex between a metal and a coordination ligand, between an antibody and an antigen or hapten, between avidin or streptavidin or analog of these with biotin or a biotin analog, between two complementary nucleic acids, between a biochemical or synthetic receptor and a drug or hormone, or between an inclusion molecule and a guest molecule. Further, an ionic linkage comprising an anionic group like carboxylate or sulphonate electrostatically paired with a cationic group like ammonium or alkylammonium can constitute a release group, or contribute to one of the prior thermal, photolytic or ligand release groups. A ligand interaction such as one of these may also be part of the linkage of the substrate to the surface without functioning as a release group. When a ligand interaction is present in either of these ways, the substrate is said to be ligandly-bound.

The energy applied directly to the release group sufficient to cleave it may be from, e.g., a Nd:YAG laser which provides 532 nm photons (from frequency doubling) for glycolketo thermal release groups, and 355 nm photons (from frequency tripling) for nitrobenzyl photolytic release groups. Neither type of photon will be absorbed by the DNA, helping to minimize the internal energy of the DNA. A first electrode surface like polyimide that absorbs 532 nm photons may be used with a glycolketo thermal release group in order to heat this surface. Ideally the heat will migrate from the surface and cleave the release group, releasing the DNA before much of the energy reaches the DNA.

DNA molecules, perhaps as a function, in part, of their size, may bear multiple charges in response to the electrical field. This problem can be minimized, if necessary, by optimizing the field and dedicating a particular first electrode for longer or shorter DNA ladder products. The disclosed technique provides adequate sensitivity for the detection of dideoxy DNA sequencing ladders. One can expect a field of $10^7$ V/cm for a tip having a radius of $10^{-3}$ cm with a potential of 10 kV. Modeling the signal-producing part of the tip as ⅓ of the surface area of a sphere with a radius of $10^{-3}$ cm, and assuming that the average area for a DNA molecule is 200×200 Å, then $10^6$ molecules could be released. The gold surface by its nature permits close spacing of simple thiol ligands, e.g. alkanethiolates on gold have a calculated area per molecule of $21.4^2$ Å (S-S spacing of 4.97Å) based on electron diffraction studies. For a DNA ladder up to a 1000-mer in size, this is $10^3$ equivalent ions for each ladder member. Assuming that the release efficiency is 10%, is and the transmission efficiency for the ions is 50%, then 50 ions of each ladder member will reach the detector. If a lower field than $10^7$ V/cm can be employed, then a larger tip radius can be used, which can increase the signal strength.

Other embodiments and variations of the disclosed invention will be apparent to those of ordinary skill in the art without departing from the inventive concepts contained herein. Accordingly, this invention is to be viewed as embracing each and every novel feature and novel combination of features present in or possessed by the invention disclosed herein and is to be viewed as limited solely by the scope and spirit of the appended claims.

What is claimed is:

1. A method of releasing a substrate into a vacuum or gas phase, comprising a) covalently or ligandly binding said substrate to the tip of a first electrode via a release group, which release group is cleavable in response to applied energy;

b) introducing an electrical field so as to establish a charge potential between said first electrode and a second electrode separated from said first electrode via a vacuum or gas phase, the strength of such field sufficient to bristle said covalently-bound or ligandly-bound substrate; and c) applying sufficient energy to said release group to cleave said release group and thereby release said substrate into a vacuum or gas phase.

2. The method of claim 1 wherein said substrate is covalently-bound to said first electrode.

3. The method of claim 1 wherein 10% or more of the total amount of said substrate released from said first electrode is nonobstructively exposed before release via the vacuum or gas phase to said second electrode.

4. The method of claim 1 wherein 50% or more of the total amount of said substrate that is released from said first electrode is nonobstructively exposed before release via the vacuum or gas phase to said second electrode.

5. The method of claim 1 wherein 90% or more of the total amount of said substrate that is released from said first electrode is nonobstructively exposed before release via the vacuum or gas phase to said second electrode.

6. The method of claim 1 wherein said first electrode comprises a metal selected from the group consisting of gold; silver; cobalt; tin; copper; gallium; arsenic, and mixtures thereof.

7. The method of claim 1 wherein said first electrode comprises a tip having a width or radius of $\leqq 100\mu$ in the part where substrate is covalently or ligandly bound.

8. The method of claim 1 wherein said first electrode comprises a tip having a width or radius of $\leqq 10\mu$ in the part where substrate is covalently or ligandly bound.

9. The method of claim 1 wherein said first electrode further comprises a coating on its surface and said substrate is covalently or ligandly bound to this coating.

10. The method of claim 1 wherein the strength of said electrical field is $\geqq 10^5$ V/cm.

11. The method of claim 1 wherein the strength of said electrical field is $\geqq 10^6$ V/cm.

12. The method of claim 1 wherein the strength of said electrical field is between $10^7$ V/cm and $10^8$ V/cm.

13. The method of claim 1 wherein said substrate is selected from the group consisting of nucleic acids; proteins; lipids; polysaccharides; microorganisms; and microscopic organic or inorganic particles.

14. The method of claim 1 wherein said substrate in said vacuum or gas phase is detected by a mass spectrometric detector.

15. The method of claim 1 wherein said applied energy is selected from the group consisting of photolytic energy; thermal energy; electrical energy; and fast atoms or ions.

16. The method of claim 1 wherein said applied energy is photolytic energy applied directly to said release group.

17. A method of releasing into a vacuum or gas phase a substrate covalently or ligandly bound to a first electrode via a release group, which release group is cleavable in response to applied energy, comprising the steps of a) introducing an electrical field so as to establish a charge potential between said first electrode and a second electrode separated by a vacuum or gas phase from said first electrode, the strength of such field sufficient to bristle said covalently-bound or ligandly-bound substrate; and b) applying sufficient energy to said release group to cleave said release group and thereby release said substrate into a vacuum or gas phase.

18. The method of claim 17 wherein said substrate is covalently-bound to said first electrode.

19. The method of claim 17 wherein 10% or more of the total amount of said substrate released from said first electrode is nonobstructively exposed before release via the vacuum or gas phase to said second electrode.

20. The method of claim 17 wherein 50% or more of the total amount of said substrate that is released from said first electrode is nonobstructively exposed before release via the vacuum or gas phase to said second electrode.

21. The method of claim 17 wherein 90% or more of the total amount of said substrate that is released from said first electrode is nonobstructively exposed before release via the vacuum or gas phase to said second electrode.

22. The method of claim 17 wherein said first electrode comprises a metal selected from the group consisting of gold; silver; cobalt; tin; copper; gallium; arsenic, and mixtures thereof.

23. The method of claim 17 wherein said first electrode comprises a tip having a width or radius of $\leqq 100\mu$ in the part where substrate is covalently or ligandly bound.

24. The method of claim 17 wherein said first electrode comprises a tip having a width or radius of $\leqq 10\mu$ in the part where substrate is covalently or ligandly bound.

25. The method of claim 17 wherein said first electrode further comprises a coating on its surface and said substrate is covalently or ligandly bound to this coating.

26. The method of claim 17 wherein the strength of said electrical field is $\geqq 10^5$ V/cm.

27. The method of claim 17 wherein the strength of said electrical field is $\geqq 10^6$ V/cm.

28. The method of claim 17 wherein the strength of said electrical field is between $10^7$ V/cm and $10^8$ V/cm.

29. The method of claim 17 wherein said substrate is selected from the group consisting of nucleic acids; proteins; lipids; polysaccharides; microorganisms; and microscopic organic or inorganic particles.

30. The method of claim 17 wherein said substrate in said vacuum or gas phase is detected by a mass spectrometric detector.

31. The method of claim 17 wherein said applied energy is selected from the group consisting of photolytic energy; thermal energy; electrical energy; and fast atoms or ions.

32. The method of claim 17 wherein said applied energy is photolytic energy applied directly to said release group.

33. A method of bristling a substrate covalently or ligandly bound to the tip of a first electrode, comprising a) exposing the bound substrate to a vacuum or gas phase; and b) introducing an electrical field so as to establish a bristling charge potential between said first electrode and a second electrode separated by a vacuum or gas phase from said first electrode.

34. The method of claim 33 wherein said substrate is covalently-bound to said first electrode.

35. The method of claim 33 wherein said first electrode comprises a metal selected from the group consisting of gold; silver; cobalt; tin; copper; gallium; arsenic, and mixtures thereof.

36. The method of claim 33 wherein said first electrode comprises a tip having a width or radius of $\leqq 100\mu$ in the part where substrate is covalently or ligandly bound.

37. The method of claim 33 wherein said first electrode comprises a tip having a width or radius of $\leqq 10\mu$ in the part where substrate is covalently or ligandly bound.

38. The method of claim 33 wherein said first electrode further comprises a coating on its surface and said substrate is covalently or ligandly bound to this coating.

39. The method of claim 33 wherein the strength of said electrical field is $\geqq 10^5$ V/cm.

40. The method of claim 33 wherein the strength of said electrical field is $\geqq 10^6$ V/cm.

41. The method of claim 33 wherein the strength of said electrical field is between $10^7$ V/cm and $10^8$ V/cm.

* * * * *

UNITED STATES PATENT AND TRADEMARK OFFICE

CERTIFICATE OF CORRECTION

PATENT NO. : 5,952,654
DATED : September 14, 1999
INVENTOR(S) : Roger Giese

It is certified that error appears in the above-identified patent and that said Letters Patent is hereby corrected as shown below:

Title page,
Item [57], ABSTRACT,
Line 11, "phased" should read -- phased. --; and Column 10,
Line 36, "is and the" should read -- and the --.

Signed and Sealed this

Twenty-ninth Day of April, 2003

JAMES E. ROGAN
*Director of the United States Patent and Trademark Office*